United States Patent [19]

Numata

[11] 4,035,634

[45] July 12, 1977

[54] LIGHT RECEPTOR DEVICE

[75] Inventor: Saburo Numata, Ohmiya, Japan

[73] Assignee: Fuji Shashin Koki Kabushiki Kaisha, Ohmiya, Japan

[21] Appl. No.: 627,916

[22] Filed: Oct. 31, 1975

[51] Int. Cl.[2] ..... H01J 39/12

[52] U.S. Cl. ..... 250/209; 250/214 P; 354/31

[58] Field of Search ..... 250/208, 209, 212, 214 P; 354/24, 26, 31, 40, 60 R

[56] References Cited

U.S. PATENT DOCUMENTS

| | | | |
|---|---|---|---|
| 3,028,499 | 4/1962 | Farrall | 250/212 |
| 3,240,943 | 3/1966 | White | 250/212 |
| 3,781,119 | 12/1973 | Mori | 250/214 P |
| 3,850,530 | 11/1974 | Uno et al. | 354/31 |

*Primary Examiner*—David C. Nelms

[57] ABSTRACT

A pair of photocells having substantially the same characteristics and directly connected in opposite relation to each other are used as a light receptor device which gives photometric input to the exposure control unit or regulator in a camera. According to this arrangement, the composite illuminance-output characteristic provided by the pair of photocells diverges from the usual proportional relation in the high illuminance range, and this feature is advantageously utilized for iris stops in cameras.

3 Claims, 7 Drawing Figures

FIG.1
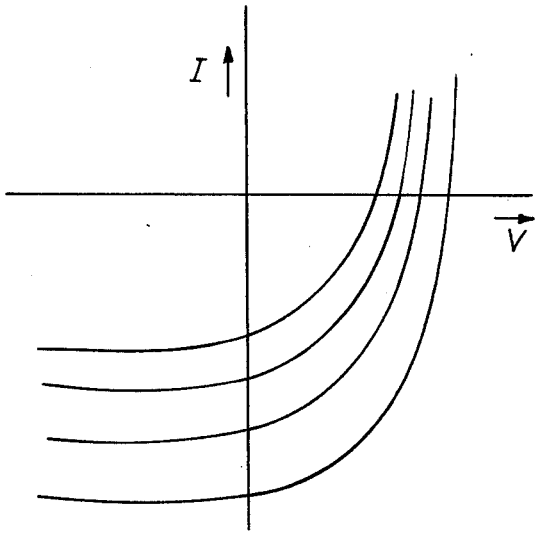
FIG.2
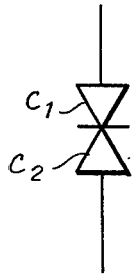
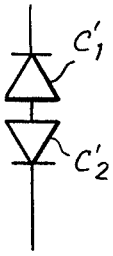
FIG.3
FIG.4
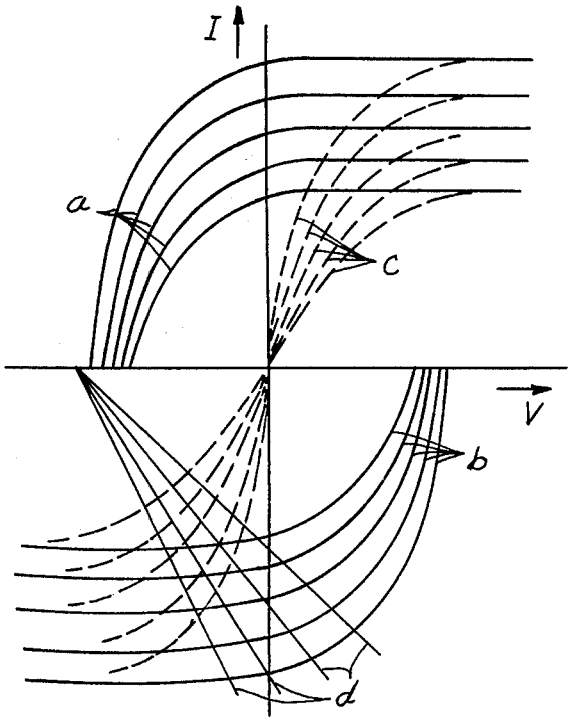

LIGHT RECEPTOR DEVICE

BACKGROUND OF THE INVENTION

This invention relates to a light receptor device for cameras in which a pair of photoelectric cells of substantially the same characteristics are directly connected such that their respective electromotive forces counteract each other to thereby improve the illuminance-output characterisitc.

Heretofore, Se photocells, Cds photoconductors and silicon photocells have been used as photoelectric converting elements for various applications according to their characteristics. Among others, silicon photocells, owing to their quick response and high reliability, have recently come to be used popularly as light receptor means for punch cards, tape reading devices or pattern discriminators of electronic computers or for automatic exposure regulators of cameras. Application of the silicon photocells as camera elements proves to be particularly advantageous because quick response and reliability are important factors for obtaining good photograph quality.

Generally, when a silicon photocell is used as a photodetector in a normal condition, an arrangement is usually made such that a proportional relation is maintained between illuminance and output (voltage or current), and this can be attained by suitably selecting the external load connected to the photocell and using the "straight" portion of the characteristic graph.

However, a problem arises in regard to using such photocell as a light receptor for the automatic exposure regulator in a camera under normal conditions. That is, since the illuminance-output characteristic of the photocell maintains the proportional relation even in the high illuminance range, the photocell output in the high illuminance section in the logarithmic representation of characteristics is extremely elevated, and this necessarily causes an increased angle of deflection of the ammeter pointer or such which is operated by such output of the photocell.

According to the well-known techniques of the prior art, deflection of the ammeter pointer is utilized as a driving power source of the stop member, and a tapering aperture which gradually changes in opening is formed in the stop member. Thus, when illuminance is high, the stop member is greatly displaced and only an extremely small portion of the aperture is formed in the exposure opening.

In such a case, if the photoelectric output characteristic holds a proportional relation even in the high illuminance range, the stop member is forced to make an unnecessarily large displacement, so that it is required to form the continuous tapered aperture which is extremely fine and elongated. This poses manufacturing difficulties.

In addition, an excessive amount of movement of the stop member is an undesirable factor in the construction of the camera. Further, the characteristics of the individual photocells inevitably vary from cell to cell, and also the proportional portion of the characteristic graph of photocells tends to be greatly affected by temperature. Thus, improvements have been required in photocells used for automatic exposure adjustment in cameras.

SUMMARY OF THE INVENTION

The primary object of the present invention is to eliminate the described defects of the photocells used in cameras, and to this end, there is provided according to the present invention an improved photocell in which the illuminance-output characteristic diverges from the proportional relation in the high illuminance range.

It is also contemplated in the present invention to provide a photocell having an arrangement capable of confining to minimum any adverse effect caused by variation of characteristics among the individual photocells. It is also an important object of the present invention to provide a photocell for cameras which is highly resistant to the influence of ambient temperature.

According to the present invention, a pair of photocells having the substantially same characteristics are directly connected in opposed relation so that their respective electromotive forces counteract each other, and such a combination of photocells is used as a light receptor means in a camera. According to this arrangement, the illuminance-output composite characteristic provided by two such combined photocells no longer shows the rectilinear tendency in the high illuminance range. Also, since the two photocells are connected in opposed relation with respect to their electromotive forces, variation of characteristics of the individual photocells as well as the adverse effect of temperature is minimized.

Now the present invention is described in detail by way of an embodiment thereof with reference to the accompanying drawings.

BRIEF DESCRIPTION OF THE DRAWINGS

FIG. 1 is a diagram illustrating the voltage-current characteristic of a known silicon photocell by considering illuminance as a parameter;

FIGS. 2 and 3 show examples of combination of two photocells connected in opposed relation to each other according to the method of the present invention;

FIG. 4 is a diagram illustrating the voltage-current characteristic of the two opposedly connected photocells by considering illuminance as a parameter;

DESCRIPTION OF THE PREFERRED EMBODIMENT

Figure 5:
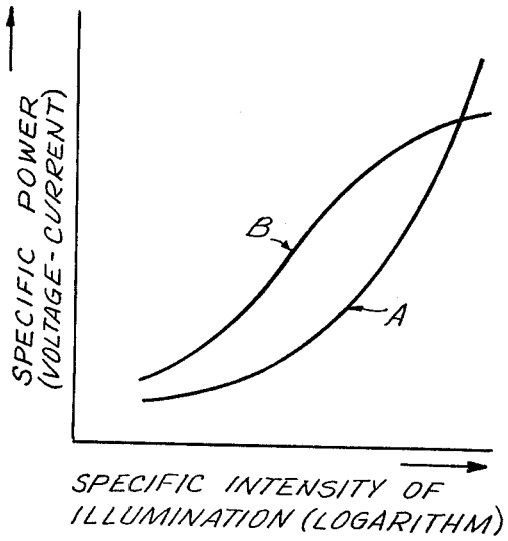
FIG. 5 is a diagram illustrating the illuminance-output characteristic of the photocells, with illuminance being expressed by way of logarithmic representation.

The photocell characteristic shown in FIG. 1 (with illuminance being considered as a parameter) is expressed in terms of the logarithmically represented illuminance and output relation in connection with the stop mechanism of the camera in FIG. 5. In the graph of FIG. 5, curve A represents the characteristic of an ordinary photocell used for photodetection. In this photocell, as noted from the graph, the illuminance-output characteristic maintains a consistent proportional relation.

Curve B represents the composite characteristic provided by two oppositely connected photocells $C_1$ and $C_2$ according to one embodiment of the present invention shown in FIG. 2. The composite characteristic depicted by curve B is obtained in the manner shown in FIG. 4. That is, if the characteristics *a* of the photocell C, and the characteristics *b* of the photocell $C_2$, are compounded, there can be obtained the composite characteristics *c*, so the load lines *d* are suitably selected in conformity to these composite characteristics *c*. These load lines *d* are so determined that they pass the shoulder portion of the characteristic lines *c*.

According to the thus obtained characteristic shown by curve B in FIG. 5, the output is not so much increased in the high illuminance range as compared with the characteristic represented by curve A.

Figure 6:
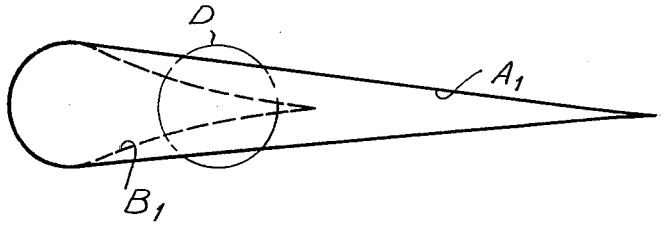
FIG. 6 shows the configuration of a tapered stop aperture.

Therefore, the angle of deflection of the ammeter which operates the stop mechanism is limited, and hence it suffices for the proportionally displaced stop member to have an aperture with a taper configuration as shown by $B_1$ in FIG. 6 with respect to the exposure opening D.

However, if the photocell characteristic becomes such as expressed by curve A in FIG. 5, the aperture must be narrowly formed and elongated for the high illuminance range as shown by $A_1$ in FIG. 6. Therefore, the characteristic shown by curve A in FIG. 5 is most desirable for the photocells used in the automatic exposure regulator for camera.

For obtaining such characteristic in a single photocell, it may be considered effective to set the load lines passing the shoulder portion of the characteristic lines shown in FIG. 1. But actually, the characteristic involved in such shoulder portion varies widely among the individual photocells and hence it can hardly be adapted for cameras which are produced in commercial quantity. Therefore, it is extremely advantageous to use the photocells by minimizing the difference of characteristic among the individual photocells as proposed in the pesent invention.

Figure 7:
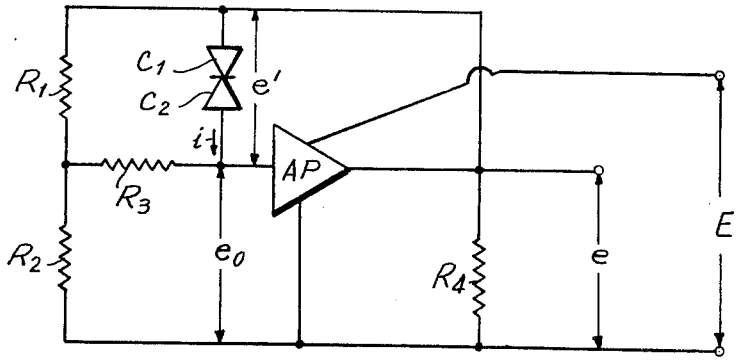
FIG. 7 is an exemplary circuit diagram showing a circuit arrangement adapted with the photocell combination shown in FIG. 2.

FIG. 7 shows an example of circuit arrangement using a combination of photocells $C_1$ and $C_2$ of the present invention in addition to the other necessary elements such as amplifier AP and resistances $R_1$–$R_4$. When an input voltage E is supplied from a power source, there is established the following relation as the input impedance of the amplifier AP is extremely high:

$$e = e_0 + e'$$

where *e* is the output voltage of the circuit, $e_0$ is the voltage at the point P and *e'* is voltage across both ends of the light receptor. Let the current flowing in the receptor be represented as *i*, which gives the following equation:

$$e_0 = iR_3 + e \cdot \frac{R_3}{R_1 + R_2}$$

Hence, $$e = (e_0 - iR_3) \cdot \frac{R_1 + R_2}{R_2}$$

The above formula shows that the output voltage *e* is a function of current *i*, so *e* is given as:

$$e = K f(i)$$

As $i = K f(L)$ (*L*: illuminance)

$$e = K f(L)$$

As it is apparent that the circuit output varies according to the characteristic of the light receptor, the load lines *d* of FIG. 4 are determined with the aid of the external load, thus obtaining the characteristic indicated by curve B in FIG. 5.

What is claimed is:

1. A light receptor device for cameras having automatic exposure regulators therein, to cover a high illuminance rage in the regulator, the device comprising, in combination: a pair of serially connected photocells having substantially the same characteristics, included in an electrical circuit that also includes an amplifier; said photocells being directly connected in opposed relation, and constituting a single photosensitive unit that is being illuminated such that the respective electromotive forces, temperature dependencies and other specific characteristics of said photocells counteract each other; no voltage being generated by said photosensitive unit, but an external electric voltage being applied across its terminals; said photocells each having individual voltage-current characteristics defined by separate curves that have substantially rectilinear and adjoining non-rectilinear portions and do not traverse the point of origin; only the non-rectilinear portion of a combined voltage-current characteristics of said photosensitive unit being used in combination with an external load, constituting a curve that traverses the point of origin; to obtain a desirable illuminance-output characteristic required for the operation of the automatic exposure regulator; wherein the illuminance-output characteristic of the combined curve diverges from a proportional, substantially rectilinear relation between power and illumination intensity, the latter approaching a flat curve portion in the high illuminance range, in the absence of the usual steep increase of the power in that range.

2. The light receptor device as defined in claim 1, wherein said amplifier has a control input and a voltage output; and a common ground for said control input, said voltage output, and a load circuit also forming part of said electrical circuit.

3. The light receptor device as defined in claim 2, wherein said load circuit includes a first resistor element connected to one terminal of said photosensitive unit, with one pole thereof, the other pole having second and third resistor elements linked thereto that respectively connect to the other terminal of said photosensitive unit and to said common ground; and a fourth resistor element shunting said other terminal of the photosensitive unit directly to said common ground.

* * * * *